US011619081B2

(12) United States Patent
Lu

(10) Patent No.: US 11,619,081 B2
(45) Date of Patent: Apr. 4, 2023

(54) DECOUPLED LATCH

(71) Applicant: Arista Networks, Inc., Santa Clara, CA (US)

(72) Inventor: Duong Lu, Santa Clara, CA (US)

(73) Assignee: ARISTA NETWORKS, INC., Santa Clara, CA (US)

( * ) Notice: Subject to any disclaimer, the term of this patent is extended or adjusted under 35 U.S.C. 154(b) by 397 days.

(21) Appl. No.: 16/665,258

(22) Filed: Oct. 28, 2019

(65) Prior Publication Data

US 2020/0131817 A1 Apr. 30, 2020

Related U.S. Application Data

(60) Provisional application No. 62/752,193, filed on Oct. 29, 2018.

(51) Int. Cl.

| | |
|---|---|
| ***E05C 19/06*** | (2006.01) |
| ***E05B 65/46*** | (2017.01) |
| ***E05B 65/00*** | (2006.01) |

(52) U.S. Cl.

CPC ..... *E05C 19/06* (2013.01); *E05B 65/0014* (2013.01); *E05B 65/46* (2013.01); *Y10T 292/0894* (2015.04); *Y10T 292/0895* (2015.04); *Y10T 292/09* (2015.04); *Y10T 292/0902* (2015.04); *Y10T 292/438* (2015.04)

(58) Field of Classification Search

CPC ..... E05C 1/10; E05C 19/06; Y10T 292/0894; Y10T 292/0895; Y10T 292/0902; Y10T 292/438; Y10T 292/09; Y10T 292/0995; E05B 65/0014; E05B 65/46; A47B 88/57; G06F 1/184; G06F 1/187

See application file for complete search history.

(56) References Cited

U.S. PATENT DOCUMENTS

| | | | | | |
|---|---|---|---|---|---|
| 4,505,526 | A * | 3/1985 | Leek | E05B 65/0014 | 312/334.44 |
| 4,840,570 | A | 6/1989 | Mann, Jr. et al. | | |
| 5,203,620 | A * | 4/1993 | McLennan | A47B 88/57 | 312/334.47 |
| 5,262,923 | A * | 11/1993 | Batta | G06F 1/184 | 439/948 |
| 5,445,451 | A * | 8/1995 | Harmony | A47B 88/57 | 312/333 |
| 5,645,304 | A * | 7/1997 | Richardson | E05B 65/0014 | 292/19 |
| 5,653,518 | A * | 8/1997 | Hardt | G11B 33/128 | |
| 5,683,159 | A * | 11/1997 | Johnson | G06F 1/187 | 312/334.7 |
| 5,828,547 | A * | 10/1998 | Francovich | G11B 33/128 | |

(Continued)

*Primary Examiner* — Christine M Mills
*Assistant Examiner* — Faria F Ahmad
(74) *Attorney, Agent, or Firm* — Fountainhead Law Group P.C.

(57) ABSTRACT

A latch includes a retention portion. The retention portion is configured to prevent a first device, coupled to the latch, from being removed while the retention portion is in a first configuration. The retention portion is configured to allow the first device to be removed while the retention portion is in a second configuration. The latch also includes a spring portion configured to allow the retention portion to transition between the first configuration and the second configuration.

20 Claims, 10 Drawing Sheets

(56) References Cited

U.S. PATENT DOCUMENTS

| | | | | |
|---|---|---|---|---|
| 5,906,422 | A * | 5/1999 | Golias, Sr. | A47B 88/402 312/334.7 |
| 6,252,514 | B1 | 6/2001 | Nolan et al. | |
| 6,343,009 | B1 * | 1/2002 | Liu | G11B 33/124 |
| 6,619,971 | B1 | 9/2003 | Chen | |
| 6,739,890 | B2 | 5/2004 | Hirata et al. | |
| 6,826,045 | B2 * | 11/2004 | Chen | G06F 1/184 |
| 6,885,550 | B1 * | 4/2005 | Williams | G06F 1/184 |
| 7,198,338 | B2 * | 4/2007 | Liu | A47B 67/04 312/223.1 |
| 7,327,565 | B2 * | 2/2008 | Chen | G11B 33/128 |
| 7,542,280 | B2 * | 6/2009 | Hong | G11B 33/12 361/679.33 |
| 7,580,253 | B1 * | 8/2009 | Chen | G06F 1/187 361/679.33 |
| 7,604,308 | B2 * | 10/2009 | Tseng | A47B 88/423 312/334.46 |
| 7,684,208 | B2 | 3/2010 | Okamoto et al. | |
| 8,083,197 | B2 * | 12/2011 | Zhang | G11B 33/124 248/27.3 |
| 8,693,182 | B2 * | 4/2014 | Kuo | G06F 1/187 248/220.21 |
| 9,581,182 | B2 * | 2/2017 | Selle | F16B 12/26 |
| 10,119,561 | B1 * | 11/2018 | Chang | F16B 1/02 |
| 10,376,055 | B2 * | 8/2019 | Chen | H05K 7/183 |
| 10,701,464 | B2 | 6/2020 | Wilcox et al. | |
| 2002/0135987 | A1 | 9/2002 | Baldwin et al. | |
| 2015/0237749 | A1 | 8/2015 | Boetzer | |
| 2019/0032372 | A1 * | 1/2019 | Andersen | E05B 65/0014 |

* cited by examiner

DECOUPLED LATCH

CROSS REFERENCE TO RELATED APPLICATIONS

This application claims priority to U.S. Provisional Patent Application No. 62/752,193 filed Oct. 29, 2018 the contents of which are hereby incorporated herein by reference.

BACKGROUND

A device may be secured to another device using a latch. For example, a slam latch may be used to secure a first device within a second device (e.g., within a housing of the second device.

SUMMARY

In some implementations, an apparatus is provided. The apparatus includes a retention portion. The retention portion is configured to prevent a first device, coupled to the latch, from being removed while the retention portion is in a first configuration. The retention portion is configured to allow the first device to be removed while the retention portion is in a second configuration. The latch also includes a spring portion coupled to the retention portion, the spring portion configured to allow the retention portion to transition between the first configuration and the second configuration.

BRIEF DESCRIPTION OF DRAWINGS

Certain embodiments of the invention will be described with reference to the accompanying drawings. However, the accompanying drawings illustrate only certain aspects or implementations of the invention by way of example and are not meant to limit the scope of the claims.

DETAILED DESCRIPTION

As discussed above, a device may be secured to another device using a latch. For example, a latch may be used to retain a power supply (e.g., a first device) within a second device (e.g., a network switch, a chassis, etc.).

Figure 1:
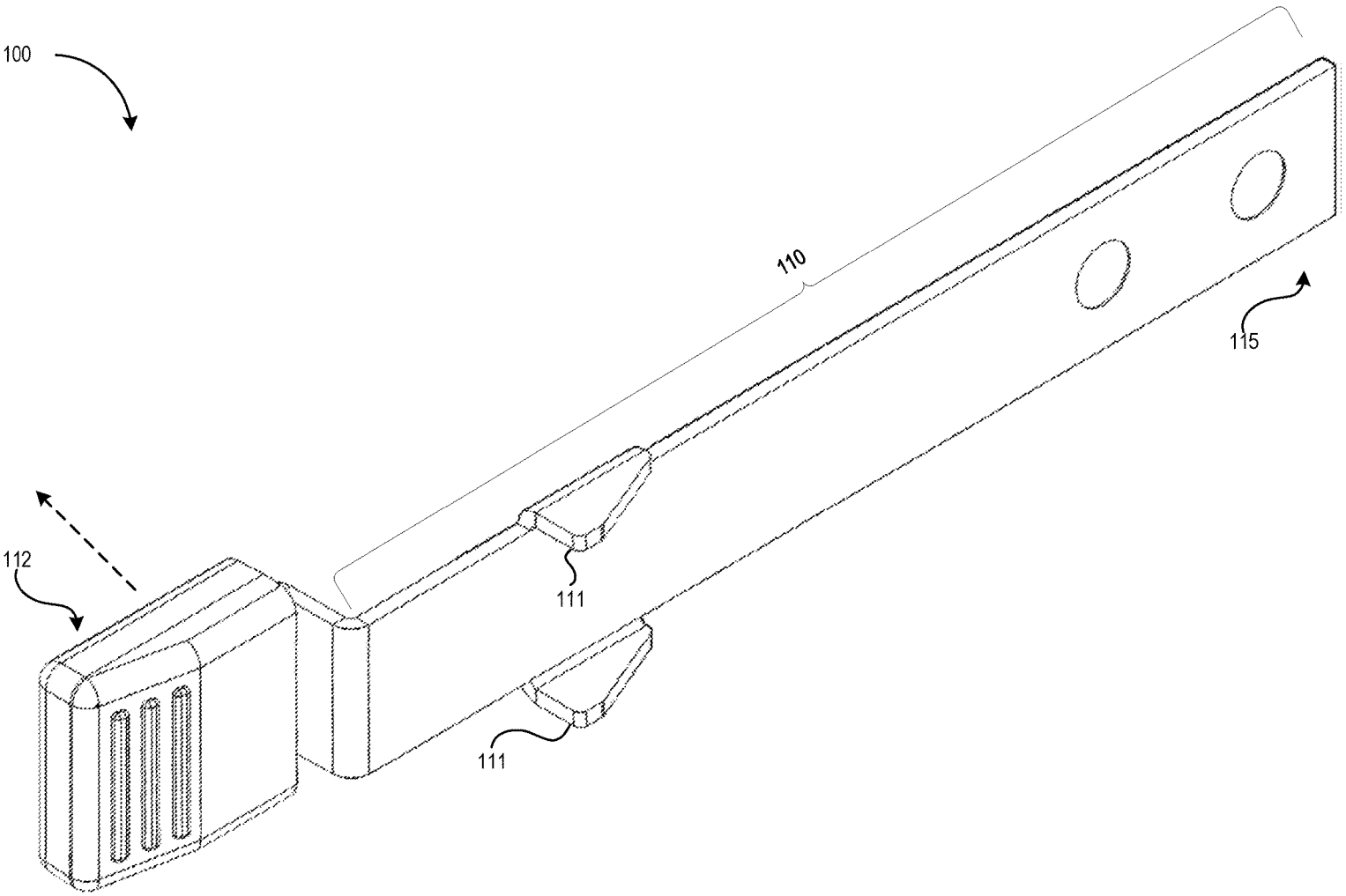
FIG. 1 illustrates a perspective view of a latch in accordance with one or more embodiments of the present disclosure.

FIG. 1 illustrates a perspective view of a latch 100 in accordance with one or more embodiments of the present disclosure. The latch 100 may be used to retain a first device within a second device (e.g., to prevent the removal of the first device from the second device. In one embodiment, the latch 100 may be referred to as a slam latch or a spring slam latch. The latch 100 may include a strip portion 110 and a handle portion 112. The strip portion 110 may be formed of a thin strip of material (metal, plastic, polymer, etc.) mounted in a cantilever beam configuration, where a portion 115 attached to a fixed point, while the handle portion 112 (e.g., another end of the latch 100) is free to move. The strip portion 110 may be a spring (e.g., a flat spring, a leaf spring, etc.). The strip portion 110 includes tabs 111 (e.g., protrusions, prongs, etc.) that may engage with a feature or surface on the second device (E.g., on the housing of another device) to prevent the removal of first device from the second device. A user may apply a force on the handle portion 112 (in the direction indicated by the dashed arrow) of the latch 100. The force applied by the user may overcome the force of the spring and may move the tabs 111 such that the tabs 111 are disengaged from the feature or surface on the second device. The force of the spring may cause the strip portion to return to its original position (before the user applied a force to the handle portion 112) once the user discontinues applying the force to the handle portion 112.

The strength of the latch 100 (e.g., the compressive strength, the latch's resistance to deforming, etc.) and the force of the spring are tightly coupled in the latch 100. For example, to make the latch 100 stronger (e.g., to increase the compressive strength, to increase the resistance to deforming, etc.) the strip portion 110 may be made thicker (e.g., thicker metal, thicker plastic, etc.). However, making the strip portion 110 thicker also increase the force of the spring. This, in turn, increases the force that a user needs to apply to overcome the force of the spring and move the tabs 111.

If the strip portion 110 is made thinner to decrease the force of the spring, this may decrease the strength (e.g., compressive strength of the latch). When an impact or other movement occurs to the first device and/or the second device, the strip portion 110 of the latch 100 may deform, bend, buckle, etc., and may not be able to properly retain or secure the first device within the second device.

Figure 2A:
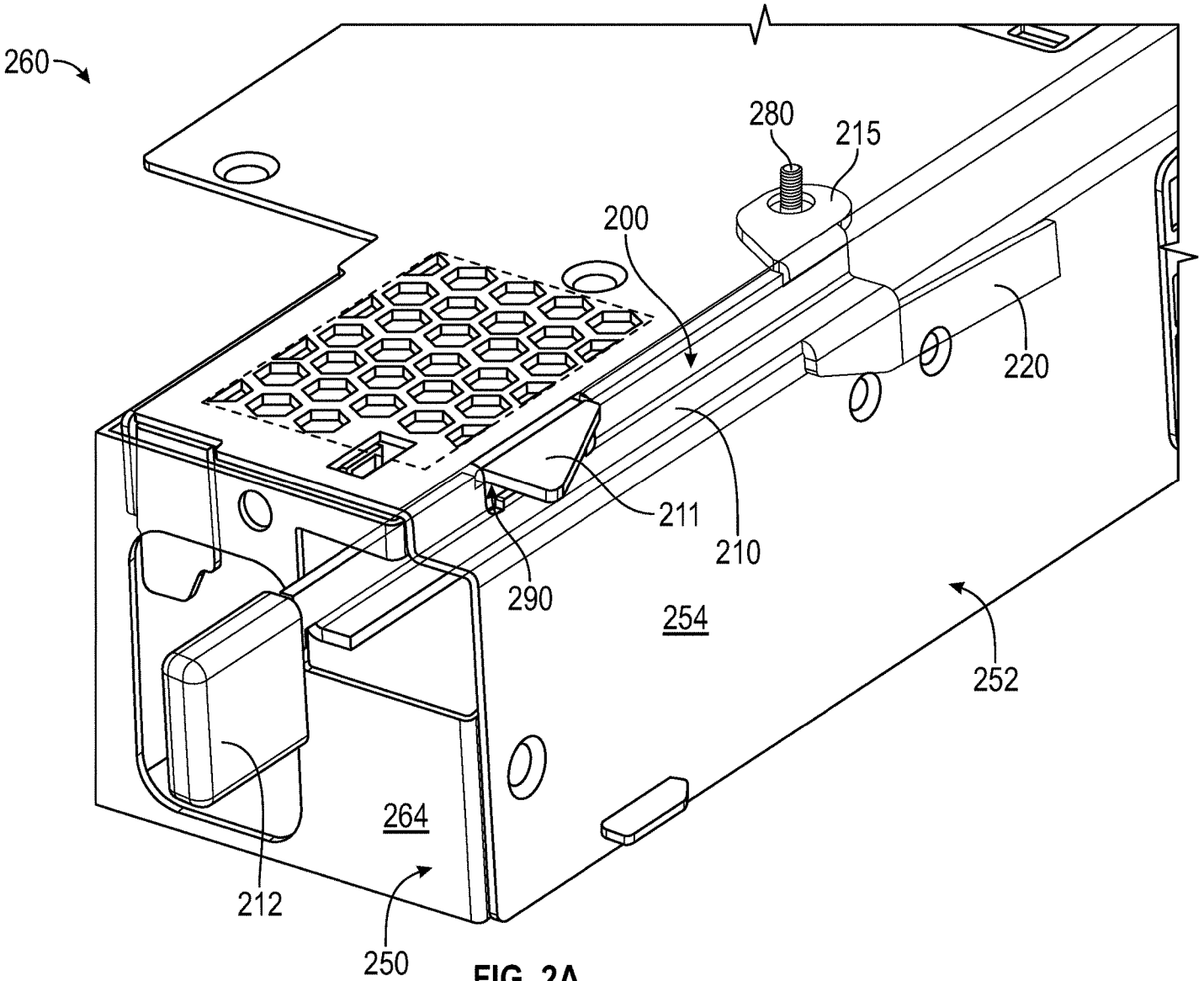
FIG. 2A illustrates a perspective view of a latch in accordance with one or more embodiments of the present disclosure in a first configuration.

FIG. 2A illustrates a perspective view of a latch 200 in accordance with one or more embodiments of the present disclosure. The latch 200 may be used to retain a first device 250 within a second device 252 (e.g., to prevent the removal of the first device from the second device. In one embodiment, the latch 200 may be referred to as a slam latch or a spring slam latch. The latch 200 includes handle portion 212, a retention portion 210, and a spring portion 220. The retention portion 210 may be formed of a strip of material (metal, plastic, polymers, etc.), where a portion 215 (e.g., an attachment or securement mechanism) is attached to a fixed point on the first device, while the handle portion 212 (e.g., another end of the latch 200) is free to move. The strip portion 210 includes a tab 211 (e.g., a protrusion, a prongs, etc.) that may engage with a feature or surface on the second device (e.g., on the housing 254 of another device) to prevent the removal of first device from the second device. Although a tab is illustrated in FIG. 2A, other types of mechanisms, components, devices, etc., may be used to prevent the removal of the first device from the second device. For example, a hook may be used to prevent the removal of the first device from the second device. In addition, the number of tabs may vary in different embodiments (e.g., fewer or more tabs may be used). Furthermore, the tab (or other mechanisms) may be located at different positions/locations in other embodiments. For example, the tab 211 may be located closer to the handle portion 212.

The latch 200 also includes a spring portion 220. The spring portion 220 may have a spring force that may be created or caused when the spring portion 220 pushes against a feature of surface of the second device. The spring portion 220 may apply a force that causes the retention portion to remain in a first configuration, as discussed in more detail below. The spring portion 220 allows the retention portion 210 to pivot about securement mechanism 215 when a force is applied to and/or removed from the handle portion 212, as discussed in more detail below.

A user may apply a force on the handle portion 212 (in the direction indicated by the dashed arrow) of the latch 200. The force applied by the user may overcome the force of the spring (e.g., the cantilever spring) of the spring portion 220 and may move the tabs 211 such that the tabs 211 are disengaged from the feature or surface on the second device. The force of the spring (of the spring portion 220) may cause the retention portion 210 to return to its original position (before the user applied a force to the handle portion 212) once the user discontinues applying the force (e.g., stop applying the force, removes the force, etc.) to the handle portion 212.

Figure 2B:
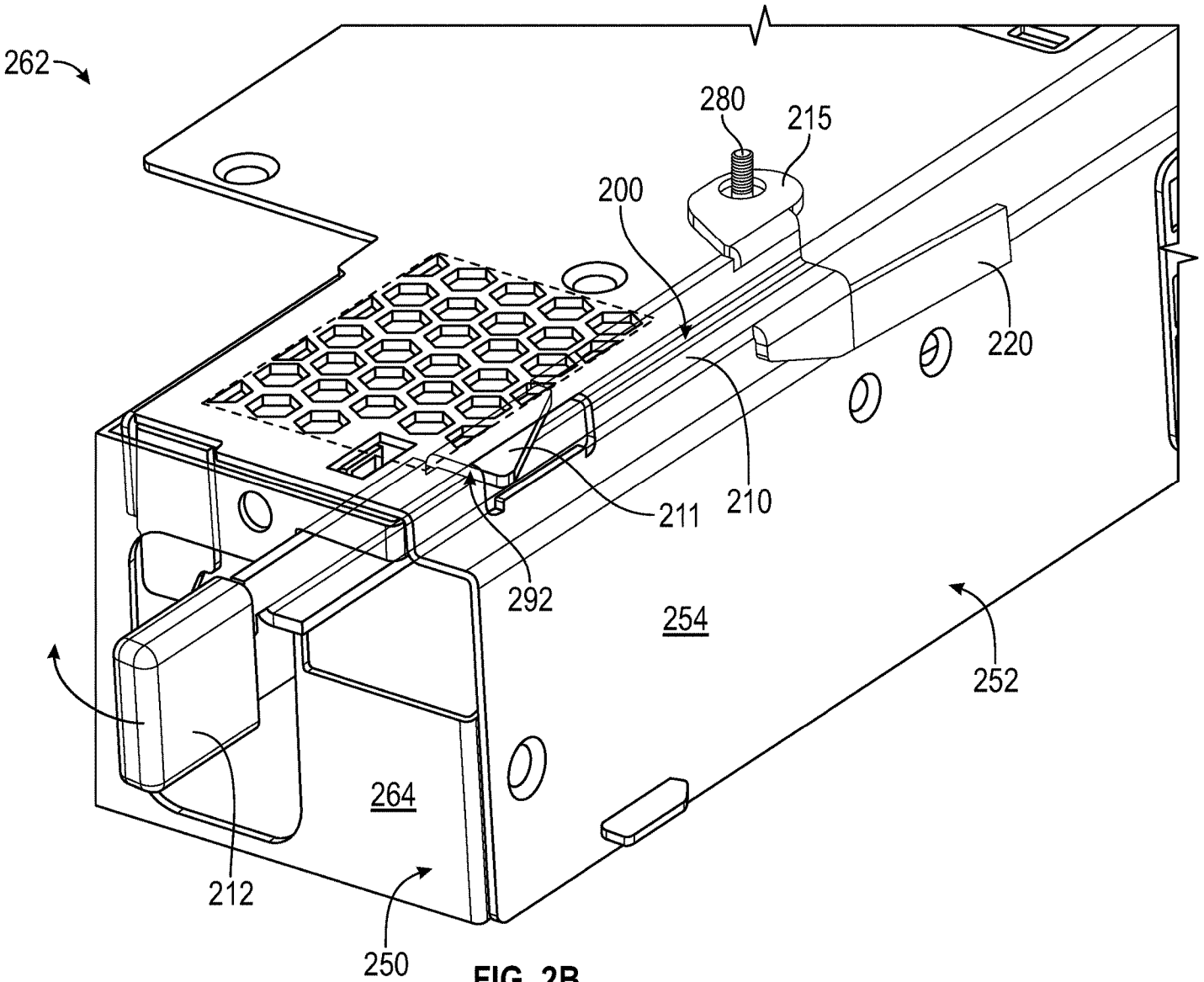
FIG. 2B illustrates a perspective view of the latch of FIG. 2A in a second configuration.

The retention portion 210 may be in different configurations or positions. For example, the retention portion 210 may be in a first configuration or a second configuration. In the first configuration 260 or position shown in FIG. 2A, retention portion 210 may prevent the first device from being removed from the second device. For example, the tab 211 of the retention portion 210 may engage (e.g., contact, touch, abut, etc.) with a feature/surface of the second device to prevent the first device from being removed from the second device. In the second configuration 262 shown in FIG. 2B, when the user applies a force on the handle portion 212, the retention portion 210 may swing toward the direction indicated by the dashed arrow, into the second configuration or position. In the second configuration, the retention portion 210 may allow the first device to be removed from the second device. For example, the tab 211 of the retention portion 210 may disengage from the feature/surface of the second device to allow the first device to be removed from the second device. Although the present disclosure may refer to a number of configurations/positions, various numbers of configurations/positions may be used in other embodiments. For example, the latch 200 may be movable to configurations and/or positions that are between the first configuration and second configuration.

The spring portion 220 may allow the retention portion 210 to transition between the first configuration and the second configuration. For example, the force of the spring in the spring portion 220 may cause the retention portion 210 to be in the first configuration/position. When a user applies a force to the handle portion 212 to overcome the spring force, the retention portion 210 may move in the direction indicated by the dashed arrow to the second configuration/position. When the user no longer applies the force to the handle portion 212, the force of the spring in the spring portion 220 may cause the retention portion 210 to move back (e.g., spring back) to the first configuration/position. For example, the retention portion 220 may move in a direction that is opposite to the dashed arrow.

As illustrated in FIG. 2, the retention portion 210 and the spring portion 220 may form a continuous piece. For example, the retention portion 210 and the spring portion 220 may be part of the same, continuous piece (e.g., a single continuous piece). In some embodiments, the manufacturing of the latch 200 may be simpler, cheaper, and/or more efficient because the retention portion 210 and the spring portion 220 form a continuous piece. For example because the retention portion 210 and the spring portion 220 form a continuous piece, the same material may be used for both the retention portion 210 and the spring portion 220 which may simply manufacturing.

In other embodiments, the retention portion 210 and the spring portion 220 may be separate pieces that are detachable from each other. For example, the retention portion 210 may be separable and/or detachable from the spring portion 220. The retention portion 210 may be attached to the spring portion 220 using various attachment mechanisms. For example, the retention portion 210 and/or the spring portion 220 may include slots, groves, rails, apertures, protrusions, etc., that allow the retention portion 210 to be attached, secured, connected, and/or coupled to the spring portion 210. In some embodiment, the latch 200 may be more configurable based on user preferences or requirements when the retention portion 210 and the spring portion 220 are separate pieces. For example, the compression strength of the retention portion 210 may be increased by using a different material in the retention portion 210 than the material in the spring portion 220. Using a different material in the retention portion 210 than the material in the spring portion 220 may be possible when the retention portion 220 is separable from the spring portion 220.

In some embodiments, the retention portion 210 and the spring portion 220 may initially be separate pieces but may be coupled into a single continuous piece when the latch 200 is manufactured or constructed. For example, the retention portion 210 may be welded, fused, etc., to the spring portion during manufacturing.

The spring portion 220 may include different types of springs, including, but not limited to, a flat spring, a compression spring, a tension spring, a torsion spring, a cantilever spring, a leaf spring, etc. Although FIG. 2 illustrates a cantilever spring, other types of springs may be used in other embodiments. For example, the spring portion 220 may include additional components that allow the spring component to include different types of spring. For example, the spring portion 220 may include a housing that may be used to hold a torsion spring.

In one embodiment, the retention portion 210 and the spring portion 220 may be made of the same material. For example, the retention portion 210 and the spring portion 220 may both be constructed of steel. In another embodiment, the retention portion 210 and the spring portion 220 may be made of different materials (e.g., different metals, different plastic materials, different polymeric materials, different composite materials, etc.). For example, the retention portion 210 may be constructed of steel and the spring portion 220 may be constructed of aluminum.

In one embodiment, the tab 211 may protrude through an opening (e.g., a hole, an aperture, etc.) in a housing 264 of the first device to interface 290 or engage with the feature/surface of the second device. The tab 211 may prevent the first device from being removed from the second device when the tab 211 engages or interfaces with the feature/surface of the second device. As discussed, when the retention portion 210 is in the second configuration of FIG. 2B, the tab 211 is retracted at 292 from the feature/surface the second device to allow the first device to be removed from the second device.

As discussed above, the handle portion 212 may be used to allow a user to transition the retention portion 210 between the first configuration/position and the second configuration/position. The handle portion 212 may provide the user with a more comfortable portion of the latch, where the user may apply a force (e.g., a pushing or pulling force) to move the retention portion 210 to a second configuration. The handle portion 212 may also include other materials, such as rubber of foam padding, etc. in other embodiments, the size, shape, and/or location of the handle portion 212 may be different. For example, the handle portion 212 may have a curved shape that allows the handle portion 212 to better conform to a user's thumb. In another example, the handle portion 212 may be located at a location that is higher or above the retention portion 220.

In one embodiment, the retention portion 210 may be less likely to deform, bend, buckle, etc., than the spring portion 220. For example, the retention portion 210 may have more compressive strength than the spring portion 220 (e.g., may have more resistance to deforming, bending, compressing, etc.). The retention portion 210 may be stronger, stiffer, etc., than the spring portion. As illustrated in FIG. 2, at least some portions of the retention portion 210 have an L-shaped cross section. The L-shaped cross section may allow the retention portion 210 to have more compressive strength than the spring portion 220, which has a flat cross section. Various other types of cross sections may be used in the retention portion 210 in other embodiments. For example, a U-shaped cross section, a triangular cross section, or some other non-flat cross section may be used in other embodiments. The cross section of the retention portion 210 may be based on a user's desires or requirements, manufacturing requirements, cost requirements, etc. In some embodiments, the retention portion 210 may have a different cross-section than the spring portion 220.

The latch 200 also includes a securement mechanism 215. The securement mechanism 215 may be configured to attach or secure the latch 200 to the first device (e.g., to a housing of the first device). The securement mechanism 215 includes a hole, an opening, an aperture, etc., configured to receive a screw, bolt, etc. In one embodiment, the securement mechanism 215 may be a pivot point that allows the retention portion 210 to swing or pivot between the first configuration/position and the second configuration/position. For example, the retention portion 210 may swing/pivot about the securement mechanism 215. In other embodiments, other types of securement mechanisms may be used. For example, slots, grooves, rails, etc., may be used to secure or attach the latch 200 to the first device.

As illustrated in FIG. 2, although the spring portion 220 is coupled to the retention portion 210, the retention portion 210 is separate from the spring portion 220. This allows the latch 200 to decouple the strength of the retention portion 210 (e.g., the retention portion 210) from the spring force of the spring portion 220. For example, the thickness of the retention portion 210, the shape of the retention portion 210, etc., may not affect the spring force of the spring portion 220. Thus, the retention portion 210 may be modified to be strong enough to resist deforming when impacts occur, without increasing the amount of force that a user needs to apply to overcome the spring force of the spring portion 220.

Figure 3:
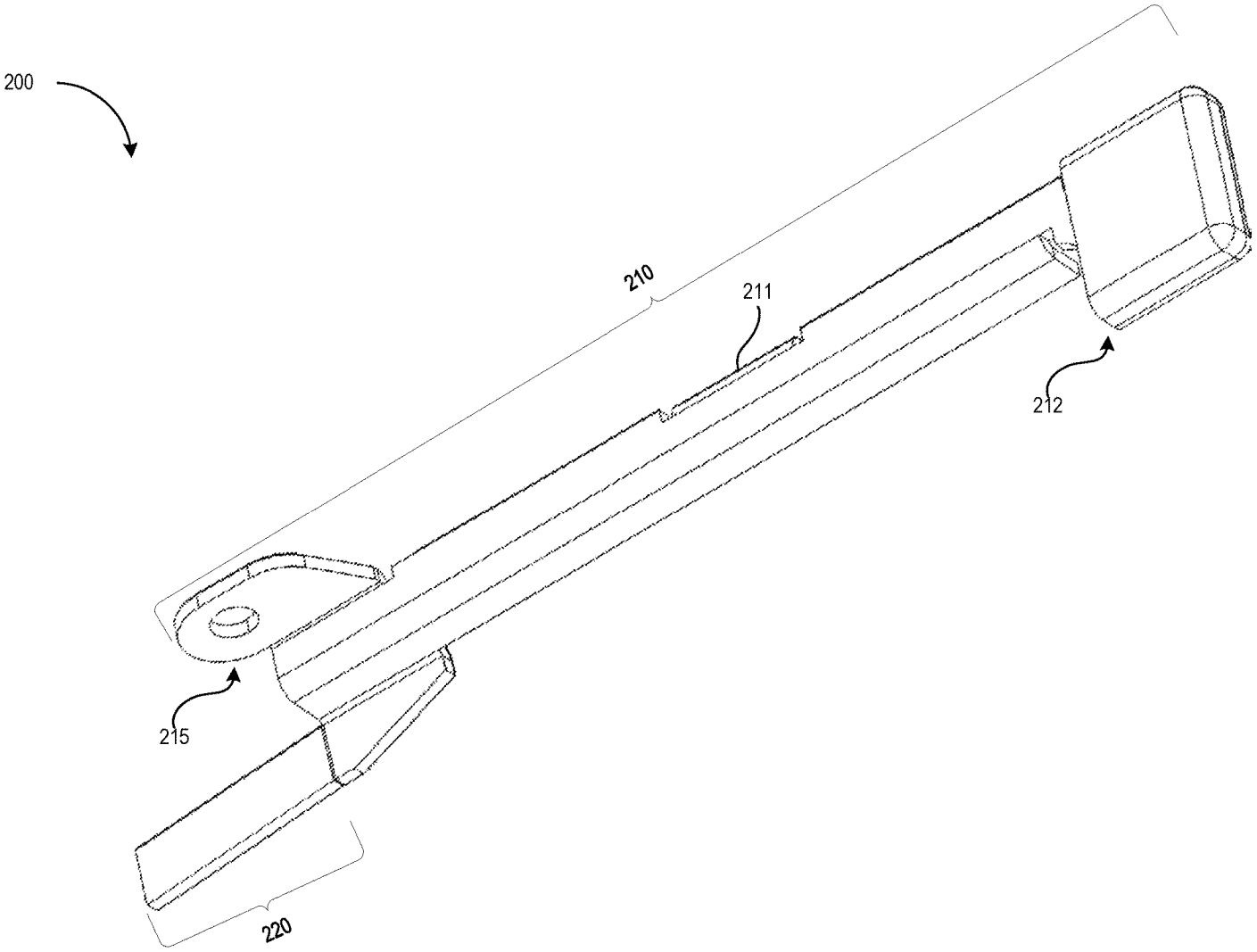
FIG. 3 illustrates a perspective view of a latch in accordance with one or more embodiments of the present disclosure.

FIG. 3 illustrates a perspective view of a latch 200 in accordance with one or more embodiments of the present disclosure. The latch 200 may be used to retain a first device within a second device (e.g., to prevent the removal of the first device from the second device). In one embodiment, the latch 200 may be referred to as a slam latch or a spring slam latch. The latch 200 includes a handle portion 212, a retention portion 210, a spring portion 220, a tab 211, and a securement mechanism 215, as discussed above.

Figure 4:
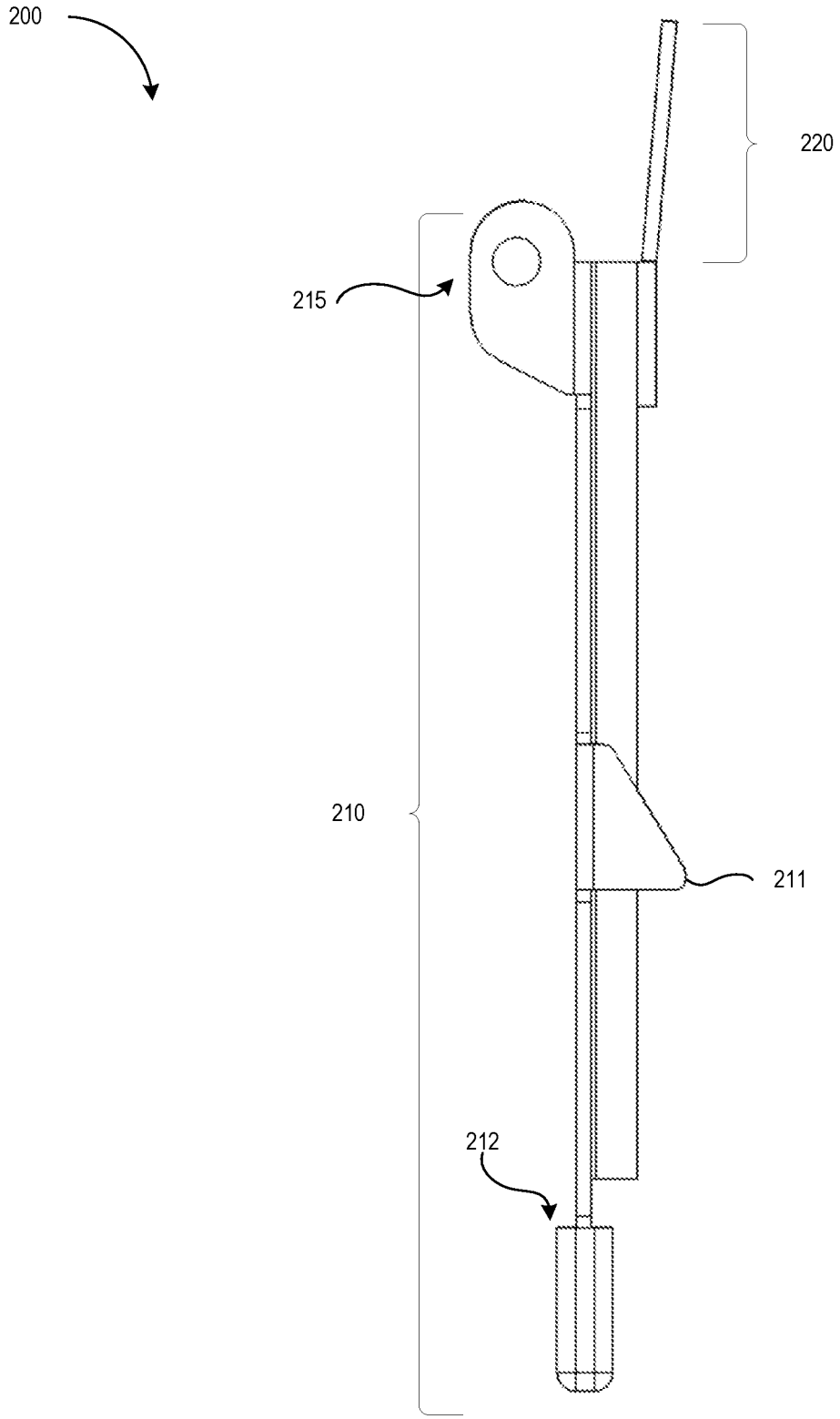
FIG. 4 illustrates a top view of a latch in accordance with one or more embodiments of the present disclosure.

FIG. 4 illustrates a top view of a latch 200 in accordance with one or more embodiments of the present disclosure. The latch 200 may be used to retain a first device within a second device (e.g., to prevent the removal of the first device from the second device). In one embodiment, the latch 200 may be referred to as a slam latch or a spring slam latch. The latch 200 includes a handle portion 212, a retention portion 210, a spring portion 220, a tab 211, and a securement mechanism 215, as discussed above.

Figure 5:
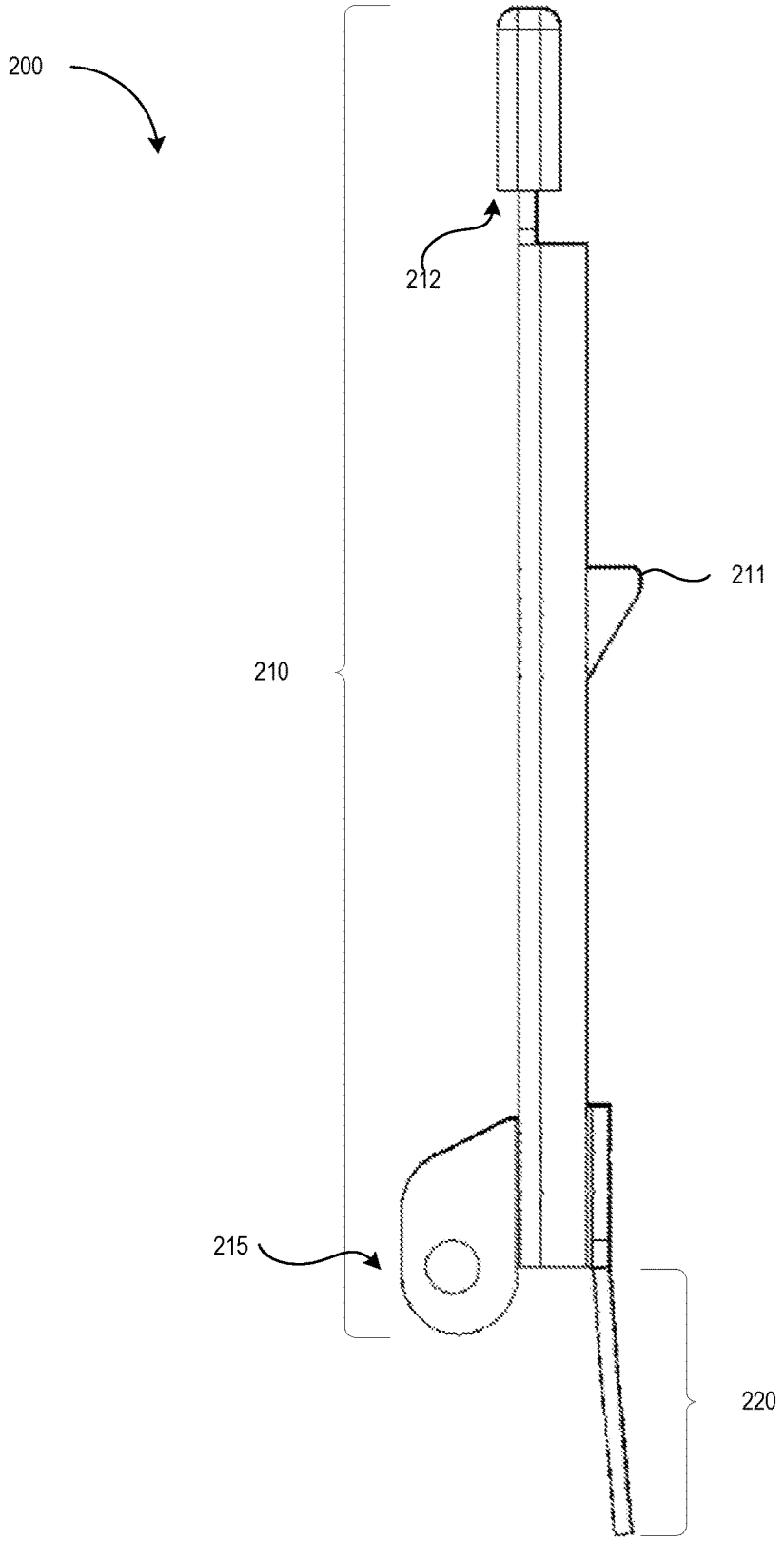
FIG. 5 illustrates a bottom view of a latch in accordance with one or more embodiments of the present disclosure.

FIG. 5 illustrates a bottom view of a latch 200 in accordance with one or more embodiments of the present disclosure. The latch 200 may be used to retain a first device within a second device (e.g., to prevent the removal of the first device from the second device). In one embodiment, the latch 200 may be referred to as a slam latch or a spring slam latch. The latch 200 includes a handle portion 212, a retention portion 210, a spring portion 220, a tab 211, and a securement mechanism 215, as discussed above.

Figure 6:
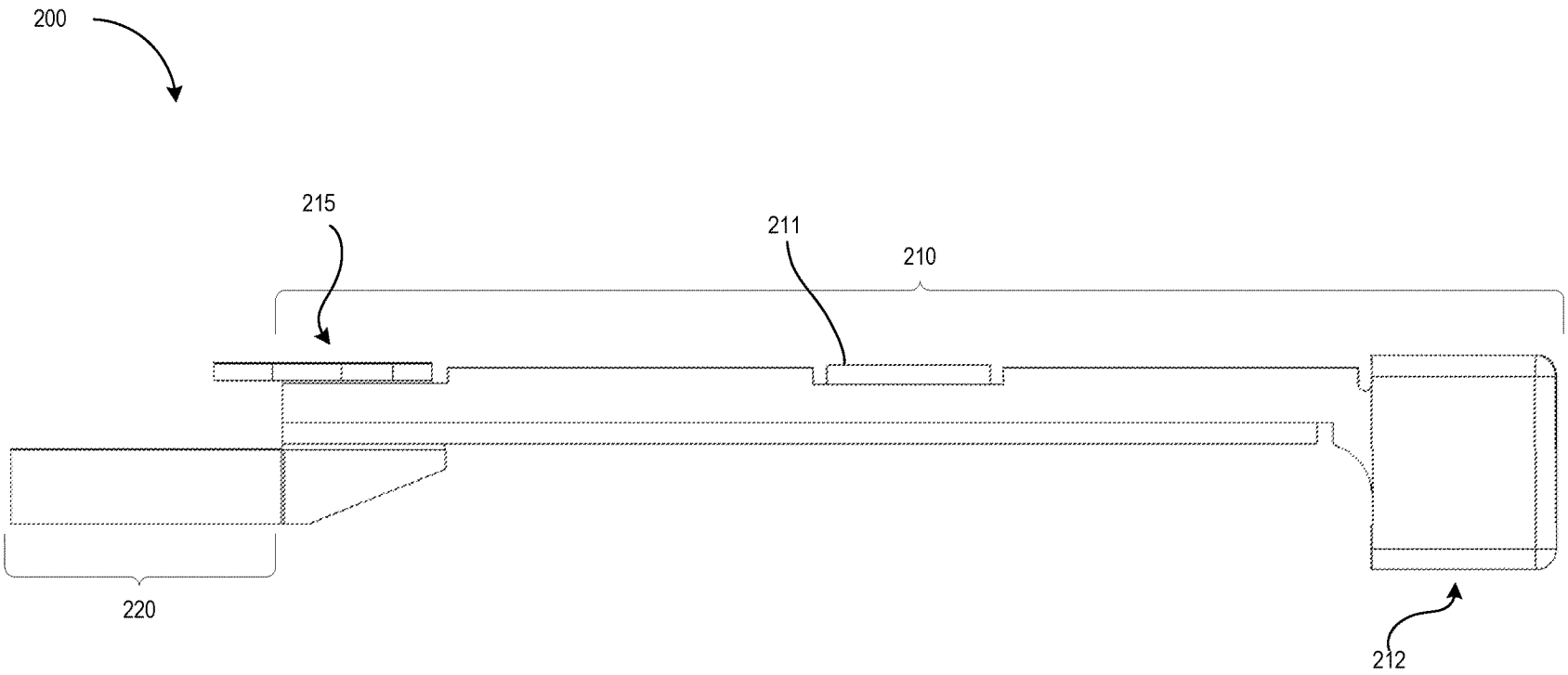
FIG. 6 illustrates a side view of a latch in accordance with one or more embodiments of the disclosure.

FIG. 6 illustrates a side view of a latch 200 in accordance with one or more embodiments of the disclosure. The latch 200 may be used to retain a first device within a second device (e.g., to prevent the removal of the first device from the second device). In one embodiment, the latch 200 may be referred to as a slam latch or a spring slam latch, as discussed above. The latch 200 includes a handle portion 212, a retention portion 210, a spring portion 220, a tab 211, and a securement mechanism 215, as discussed above.

Figure 7:
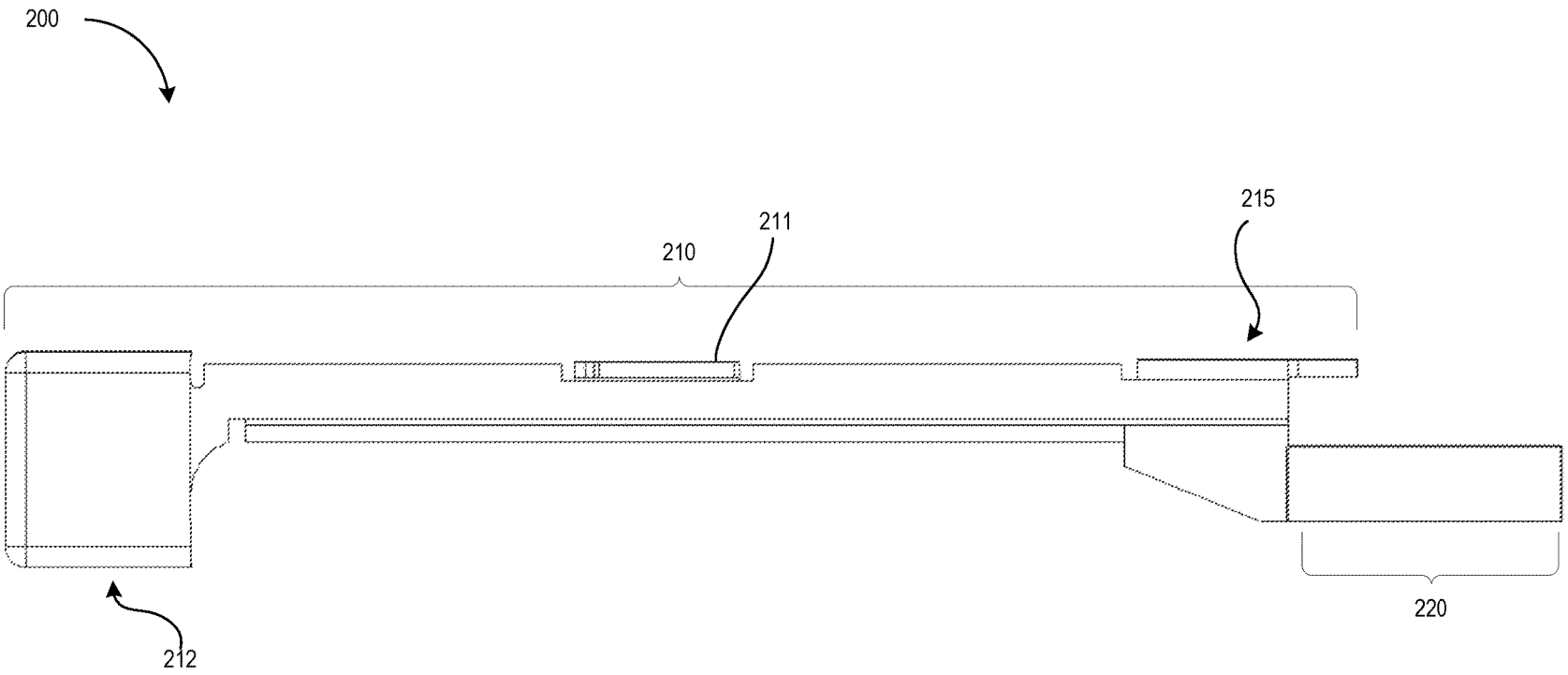
FIG. 7 illustrates a side view of a latch in accordance with one or more embodiments of the present disclosure.

FIG. 7 illustrates a side view of a latch 200 in accordance with one or more embodiments of the present disclosure. The latch 200 may be used to retain a first device within a second device (e.g., to prevent the removal of the first device from the second device). In one embodiment, the latch 200 may be referred to as a slam latch or a spring slam latch. The latch 200 includes a handle portion 212, a retention portion 210, a spring portion 220, a tab 211, and a securement mechanism 215, as discussed above.

Figure 8:
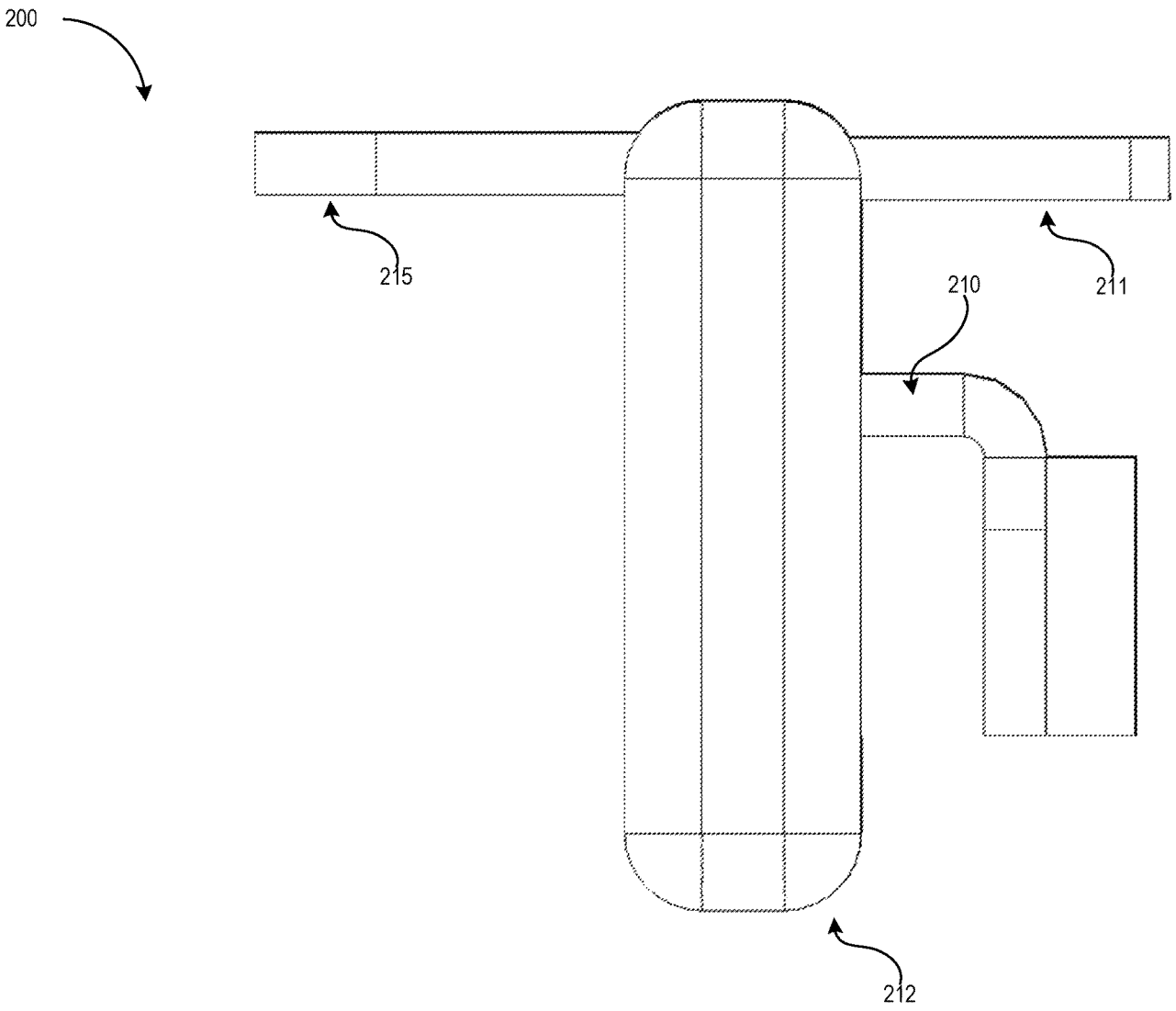
FIG. 8 illustrates a front view of a latch in accordance with one or more embodiments of the present disclosure.

FIG. 8 illustrates a front view of a latch 200 in accordance with one or more embodiments of the present disclosure. The latch 200 may be used to retain a first device within a second device (e.g., to prevent the removal of the first device from the second device). In one embodiment, the latch 200 may be referred to as a slam latch or a spring slam latch. The latch 200 includes a handle portion 212, a retention portion 210, a spring portion 220, a tab 211, and a securement mechanism 215, as discussed above.

Figure 9:
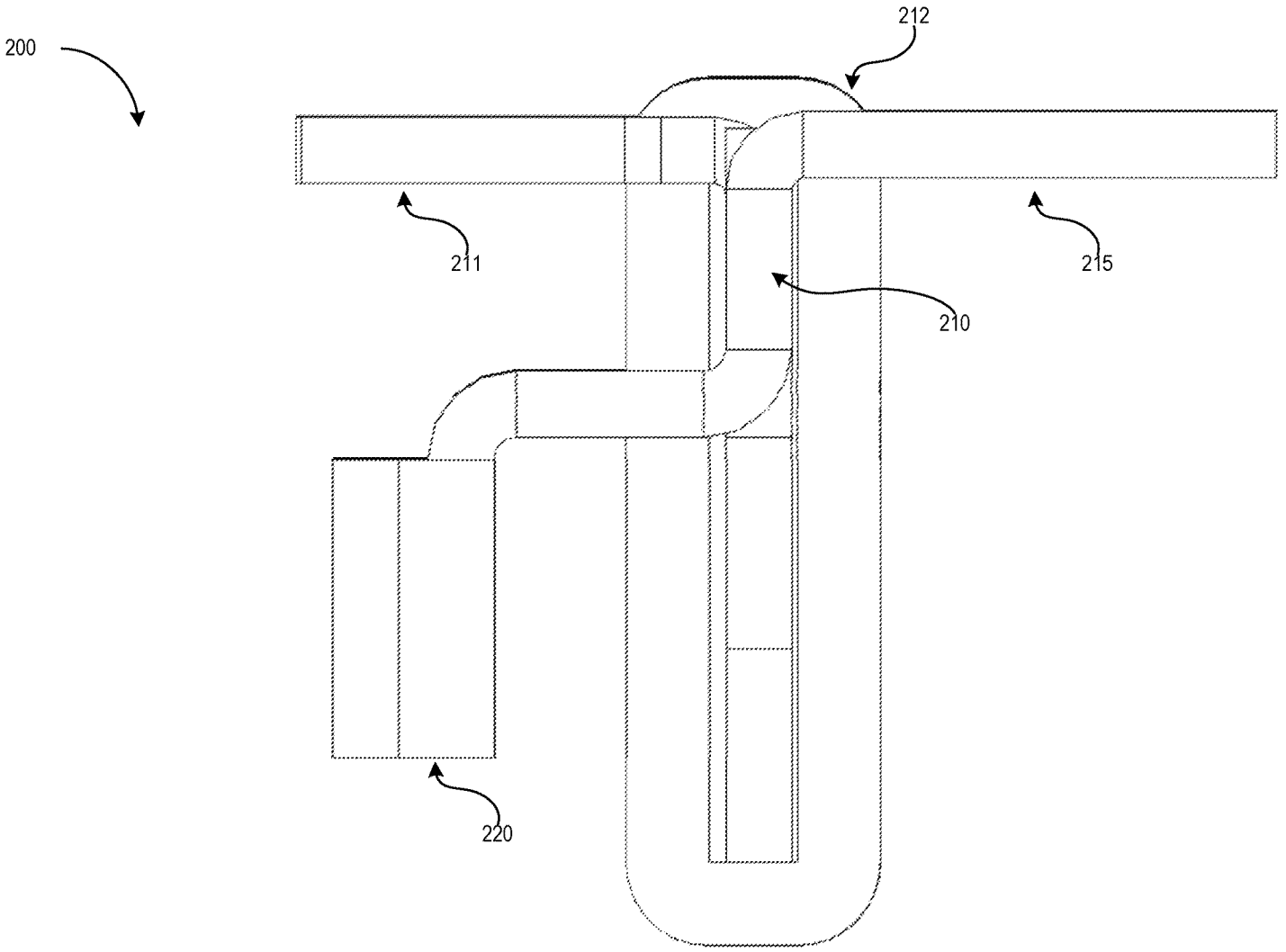
FIG. 9 illustrates a back view of a latch in accordance with one or more embodiments of the present disclosure.

FIG. 9 illustrates a back view of a latch 200 in accordance with one or more embodiments of the present disclosure. The latch 200 may be used to retain a first device within a second device (e.g., to prevent the removal of the first device from the second device). In one embodiment, the latch 200 may be referred to as a slam latch or a spring slam latch. The latch 200 includes a handle portion 212, a retention portion 210, a spring portion 220, a tab 211, and a securement mechanism 215, as discussed above.

As used herein, the singular forms "a", "an" and "the" are intended to include the plural forms as well, unless the context clearly indicates otherwise. In addition, the term "set" includes one or more items within the set. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof. Therefore, the terminology used herein is for the purpose of describing particular embodiments only and is not intended to be limiting.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the embodiments and its practical applications, to thereby enable others skilled in the art to best utilize the embodiments and various modifications as may be suited to the particular use contemplated. Accordingly, the present embodiments are to be considered as illustrative and not restrictive, and the invention is not to be limited to the details given herein, but may be modified within the scope and equivalents of the appended claims.

What is claimed is:

1. A latch for reversibly anchoring a first device within a second device comprising:

a longitudinal retention portion extending along a first longitudinal axis from a first end to a second end, said longitudinal retention portion having a horizontal segment and a vertical segment, such that the longitudinal retention portion forms an L-shape;

the first end of the longitudinal retention portion having a handle extending from the vertical segment;

the second end of the longitudinal retention portion having a spring portion extending substantially vertically from the horizontal segment, said spring portion comprising a substantially flat piece, wherein the spring portion is offset from the vertical segment by a first distance, wherein the first distance is a width of the horizontal segment;

the second end of the longitudinal retention portion having a securement mechanism extending substantially horizontally from the vertical segment, said securement mechanism configured to engage with the first device; and a tab protruding from the longitudinal retention portion configured to engage with an opening in the second device.

2. The latch of claim 1, wherein the handle extends substantially vertically from the vertical segment of the longitudinal retention portion.

3. The latch of claim 1, wherein the securement mechanism comprises an opening configured to receive a fastener therethrough.

4. The latch of claim 1, wherein the longitudinal retention portion comprises a first material and the spring portion comprises a different second material.

5. The latch of claim 1, wherein the longitudinal retention portion has a larger compressive strength than the spring portion.

6. The latch of claim 1, wherein the longitudinal retention portion is more resistant to buckling than the spring portion.

7. The latch of claim 1, wherein the longitudinal retention portion is less flexible than the spring portion.

8. A latch for reversibly anchoring a first device within a second device comprising:

a L-shaped longitudinal retention portion extending along a first longitudinal axis from a first end to a second end, said longitudinal retention portion having a first planar segment extending along a first plane and a second planar segment extending along a second plane, which together form the L-shape;

the second end of the longitudinal retention portion having a spring portion extending from the first planar segment, said spring portion comprising a substantially planar piece, wherein the spring portion is offset from the second planar segment by a first distance;

the second end of the longitudinal retention portion having a securement mechanism extending from the second planar segment, said securement mechanism configured to engage with the first device; and a tab protruding from the longitudinal retention portion configured to engage with an opening in the second device.

9. The latch of claim 8, wherein said spring portion extends along a third plane that is offset and substantially parallel to the second plane of the second planar segment of the longitudinal portion.

10. The latch of claim 8, wherein said securement mechanism extends in a fourth plane that is offset and substantially parallel to the first plane of the first planar segment of the longitudinal portion.

11. The latch of claim 8, wherein the longitudinal retention portion and the spring portion are configured to contact an inner surface of the first device and are configured to contact an outer surface of the second device.

12. The latch of claim 8, wherein the second device is configured to retain the first device therein.

13. The latch of claim 8, wherein the first end of the longitudinal retention portion has a handle extending from the second segment.

14. The latch of claim 9, wherein said securement mechanism extends in a fourth plane that is offset and substantially perpendicular to the third plane of the spring portion.

15. A latch for reversibly anchoring a first device within a second device comprising:

a longitudinal retention portion extending along a first longitudinal axis from a first end to a second end, said longitudinal retention portion having a first flat segment extending along a first plane and a second flat segment extending along a second plane;

the second end of the longitudinal retention portion having a spring portion extending from the first flat segment, said spring portion comprising a substantially flat piece, wherein the spring portion is offset from the second flat segment by a first distance;

the second end of the longitudinal retention portion having a securement mechanism extending from the second flat segment, said securement mechanism configured to anchor the latch to the first device; and a tab protruding from the longitudinal retention portion configured to extend through an opening in the second device.

16. The latch of claim 15, wherein the first plane and the second plane are substantially perpendicular to each other.

17. The latch of claim 15, wherein said spring portion extends along a third plane that is offset and substantially parallel to the second plane.

18. The latch of claim 15, wherein said securement mechanism extends in a fourth plane that is offset and substantially parallel to the first plane.

19. The latch of claim 17, wherein said securement mechanism extends in a fourth plane that is offset and substantially parallel to the first plane.

20. The latch of claim 15, wherein the first end of the longitudinal retention portion has a handle extending from the second flat segment.

* * * * *